United States Patent [19]

Myers

[11] Patent Number: 4,524,884

[45] Date of Patent: Jun. 25, 1985

[54] BINGO COVER DISPENSER

[76] Inventor: William C. Myers, Box 331, Salt Fork Rd., Lawrenceburg, Ind. 47025

[21] Appl. No.: 405,331

[22] Filed: Aug. 5, 1982

[51] Int. Cl.[3] ..... B65H 1/12

[52] U.S. Cl. ..... 221/231; 133/5 A

[58] Field of Search ..... 221/259, 277, 231, 228, 221/229, 280; 133/5 A, 5 R, 5 B, 8 B

[56] References Cited

U.S. PATENT DOCUMENTS

| | | | |
|---|---|---|---|
| 462,220 | 10/1891 | Michl | 133/6 |
| 862,984 | 8/1907 | Marsh | 133/6 |
| 1,276,493 | 8/1918 | Cooke | 221/231 |
| 2,245,066 | 6/1941 | Bouchard | 133/5 A |
| 3,393,688 | 7/1968 | Saverino | 133/6 |
| 3,401,704 | 9/1968 | Davin | 133/5 R |
| 4,099,532 | 7/1978 | Mascherin | 133/5 A |
| 4,171,753 | 10/1979 | Vreede | 133/5 A |
| 4,216,878 | 8/1980 | Naud | 133/5 A |

*Primary Examiner*—Stanley H. Tollberg
*Attorney, Agent, or Firm*—Frost & Jacobs

[57] ABSTRACT

A device for dispensing the covers used in playing the game of bingo which has an elongated tubular magazine, resilient means within the magazine to advance the covers, and a rotating member at the dispensing end of the magazine to dispense the forwardmost cover. The covers are stored within the magazine at an inclined angle and the magazine has means to faciliate placement of the covers directly onto the bingo card.

10 Claims, 4 Drawing Figures

BINGO COVER DISPENSER

BACKGROUND OF THE INVENTION

1. Field of the Invention.

This invention relates generally to a spring-loaded token dispenser and more particularly to a dispenser provided with a rotating member to facilitate removal of tokens.

2. Description of the Prior Art.

The game of bingo is played using cards that are divided by markings into a plurality of squares. Each square is identified by a letter of the word "bingo" and a number which is printed within the square. As the game is played, a "caller" picks at random a letter-number combination. Players who have a card with the particular letter-number combination called, mark that square by placing a "cover" (thin disk) over that square. The object of the game is to get a number of covers in a row on the card or to cover the entire card.

Typically, the covers are placed on the card by hand as play progresses; during a slow paced game, this method is usually satisfactory. However, an individual will frequently play a number of cards during a single game to increase the chances of winning. In this situation it is often difficult to check each card and place the necessary covers before the next letter-number is called. This is particularly true for senior citizens and others who may have somewhat limited dexterity.

Although some prior art workers have developed devices to aid in the placement of covers, none have proven completely satisfactory. Generally, such devices are more effective than hand placement of the cover, but tend to be of rather complex construction. This complexity in construction means increased cost in manufacture and a likelihood that the device will jam or otherwise fail. In addition, some of the devices are awkward to handle, with the result that they are little or no better than hand placement.

SUMMARY OF THE INVENTION

The bingo cover dispenser of the present invention has a spring-loaded magazine to house and advance the covers, a rotating member positioned at the top of the magazine to facilitate removal of the covers, and means to aid in placing a cover directly on the appropriate square of the card. The rotating member is simply a wheel and axle combination. The circumference of the wheel provides sufficient friction to slide a cover smoothly from the magazine as the wheel is rotated with the user's thumb. To aid in placement of the cover, the exit end of the magazine is extended and serves as a guide for the cover as it leaves the magazine. Preferably, the covers in the magazine are inclined with respect to the centerline of the magazine to facilitate easy removal and accurate placement of the cover.

Having a minimal number of parts and a simple construction, the present invention provides a device for dispensing covers that operates efficiently yet is economical to manufacture. The device can dispense covers quickly which enables the user to deposit the covers on a number of cards more rapidly. The tubular magazine is easy to handle and can be quickly loaded with a quantity of covers.

DETAILED DESCRIPTION

Figure 1:
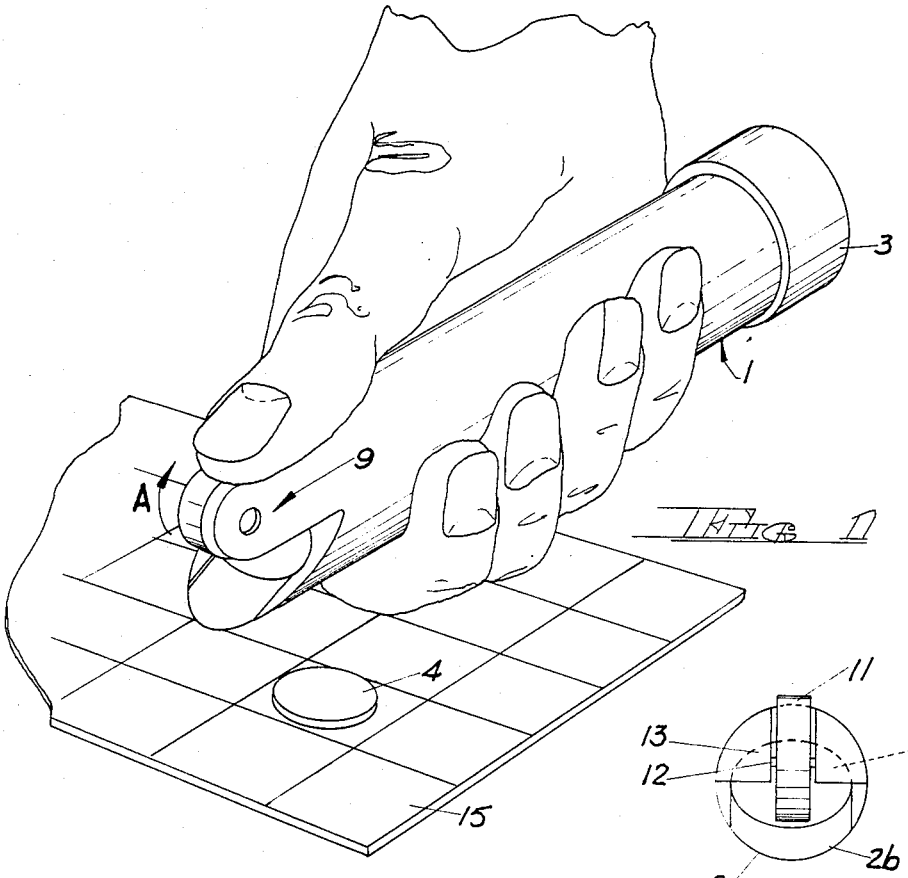
FIG. 1 is a perspective view of the bingo cover dispenser of the present invention illustrating the manner in which it is used.
Figure 2:
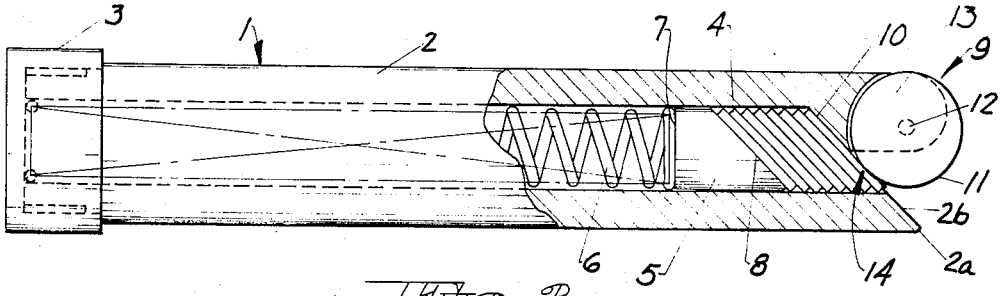
FIG. 2 is a longitudinal sectional view of the bingo cover dispenser.

As best illustrated in FIGS. 1 and 2, the basic structural element of the present invention is a magazine, indicated generally at 1. The magazine 1 has an elongated, tubular body 2 which is closed at one end by a cap 3. The cap 3 attaches to the body 2 by any conventional means, such as internal threads of the cap 3 which engage external threads on the end of the body 2. The body 2 is of sufficient length to allow the magazine 1 to house a sufficient number of covers 4, but not so long as to make the dispenser awkward to handle. Preferably, the body 2 and cap 3 are made of a lightweight, economical material, such as plastic, which will provide the necessary strength but minimize cost of manufacture. Holding the covers 4 in the proper alignment within the magazine 1 is a plunger 5 supported by a coil spring 6. The spring 6 provides the necessary resiliency to advance the covers 4 as they are dispensed and the number within the magazine decreases.

Figure 3:
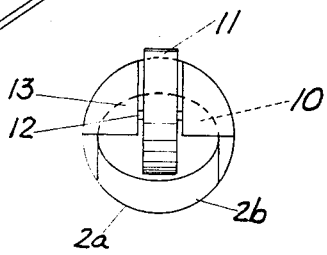
FIG. 3 is an end view of the dispenser as seen from the right in FIG. 2.

In the preferred embodiment, the covers 4 are stored within the magazine 1 on an inclined angle. This is accomplished by providing the plunger 5 with a rear surface 7 that rests flat against the coil spring 6 and an inclined forward surface 8 which is at an oblique angle with respect to the centerline of the magazine 1. As seen in FIG. 3, the interior of the tubular body 2 is preferably oval in cross-section to assure that the covers 4 are properly aligned and stacked in an inclined relationship.

Obviously, the plunger 5 could have a flat forward surface rather than the inclined surface 8. This would cause the covers 4 to lay flat in the magazine and necessitate a circular interior for the tubular body 2. However, it has been found to be advantageous to have the covers 4 inclined as previously described, as will be more fully discussed hereinafter.

At the exit end of the magazine the covers 4 are restrained by a rotating member 9 and a partial wall 10. Preferably, the rotating member 9 is simply a wheel 11, mounted on an axle 12. The wheel 11 is constructed so that its circumference will frictionally engage the forwardmost cover 4; relatively soft rubber has proven to be a suitable material for the wheel 11. The axle 12 is supported aand confined by any conventional means such as brackets 13; the brackets 13 can simply be extensions above the partial wall 10. To minimize the possibility of one of the covers 4 accidentally sliding out of the magazine 1, the wheel 11 should contact the lower half of the forwardmost of the covers 4, as indicated at 14.

Figure 4:
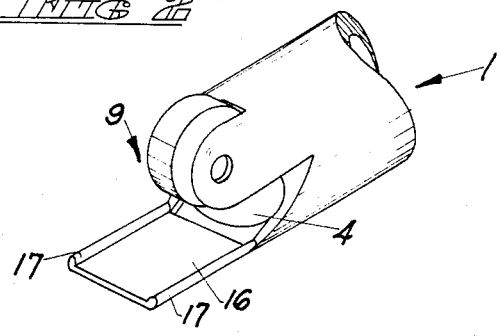
FIG. 4 is a fragmentary perspective view showing the bingo cover dispenser with an extension at the exit end of the magazine to aid in the placement of the covers.

As previously indicated, the covers 4 are stored on an incline within the magazine 1. This enables the front edge **2*a* at the exit end of the tubular body 2 to serve as means for facilitating the placement of a cover 4 directly on a bingo card 15. As shown in FIGS. 2 and 3** the front edge is notched at *2b* to allow the forwardmost cover 4 to pass from the stack over the front edge *2a* of the tubular body 2 and onto the card. To further aid in the placement of the covers 4 on the card 15, the magazine 1 may alternatively be provided with an extension 16, as illustrated in FIG. 4. The extension 16 will enable the player to hold the dispenser a greater distance from the card 15 while still being able to accurately place the cover 4. If desired, the extension 16 can be provided with side walls 17 to insure that the cover 4 will be effectively placed on the card 15 without lateral shifting.

Prior to use, the bingo player must fill the dispenser with a supply of covers 4. This is accomplished by removing the cap 3 along with the plunger 5 and coil spring 6. A number of the covers 4 are then inserted into the tubular body and the plunger 5, spring 6 and cap 3 are replaced. After the dispenser is loaded, the player is able to dispense the covers 4 one at a time by rotating the wheel 11 in the direction of Arrow A (see FIG. 1) with his thumb. The frictional contact between the wheel 11 and the forwardmost cover 4 causes the cover 4 to slide from the stack and out through the notch *2b* in the front edge *2a* of the tubular body 2. Once the cover 4 is out of contact with the wheel 11 it will slide freely from the magazine to the card 15. If the magazine 1 is provided with the extension 16 having side walls 17, the cover 4 will pass onto the extension 16 and be restrained by the side walls 17 until it is pushed off the extension 16 and onto the card 15 by a succeeding cover 4.

As should now be evident, the present invention provides an effective device for dispensing the covers used in playing the game of bingo. Modifications may be made to the various components of the invention, such as the shape of the interior and exterior of the tubular body, without departing from the spirit and purpose of the invention. In addition, although the invention is illustrated and described as a dispenser for bingo covers, it is evident that the device is suitable for dispensing any type of disc-shaped article or token.

What is claimed is:

1. A device for dispensing generally flat circular covers used in playing the game of bingo comprising:

a magazine having an elongated tubular body of substantially oval cross sectional shape wherein the shorter dimension of said oval shape is less than the diameter of a cover, said magazine having one end configured to load a stack of covers into the magazine so that the covers rest therewithin in shingled relationship at inclined angles with respect to the longitudinal axis of the magazine with their outer peripheries substantially in contact with the inner wall of said tubular body, and an opening in the opposite end of the magazine for dispensing covers therefrom one at a time;

a cap removably attached to said loading end of the body; and a manually operable wheel rotatably mounted on the dispensing end of the magazine adjacent said opening such that the outer surface of the wheel lies in abutting contact with the inclined surface of a cover presented at said dispensing opening, said presented cover being slidably retained between said wheel and the next in-line cover, said wheel when rotated operating to frictionally engage said presented cover and slide it outwardly at an oblique angle with respect to the longitudinal axis of the magazine from the stack of covers contained within the magazine until the presented cover clears said magazine, said dispensing device being configured so that said body may be grasped in one hand and said wheel operated by a rolling motion of the thumb of the same hand, said wheel being dimensioned so that said presented cover may be dispensed and completely clear the magazine with a single rolling motion of the thumb.

2. The device claimed in claim 1 including means disposed within said magazine for urging the stack of covers toward said dispensing opening.

3. The device claimed in claim 1 including means to facilitate placement of a cover as it exits the magazine.

4. The device claimed in claim 2 wherein said urging means comprises spring means and a plunger positioned between said loading end of the magazine and the stack of covers, said spring means operating to urge the plunger against the rearmost end of the stack of covers, said plunger including an inclined forward surface for abutting the inclined surface of the rearmost cover.

5. The device claimed in claim 1 wherein the cap is threaded onto the tubular body.

6. The device claimed in claim 3 wherein the means to facilitate placement is formed by the front edge of the tubular body of the magazine.

7. The device claimed in claim 3 wherein the means to facilitate placement includes an extended member at the dispensing end of the magazine.

8. The device claimed in claim 1 wherein the forwardmost end of the dispensing end of the magazine is provided with a downwardly and forwardly sloping surface positioned so that a cover presented for dispensing is guided between said surface and said wheel.

9. The device claimed in claim 7 wherein the extended member has side walls which restrain the cover as it leaves the device.

10. The device claimed in claim 4 wherein the forwardmost end of the dispensing end of the magazine is provided with a downwardly and forwardly sloping surface positioned so that a cover presented for dispensing is guided between said surface and said wheel.

* * * * *